US009343281B2

(12) United States Patent
Flory

(10) Patent No.: US 9,343,281 B2
(45) Date of Patent: May 17, 2016

(54) METHODS AND APPARATUS FOR INCREASED ION THROUGHPUT IN TANDEM MASS SPECTROMETERS

(71) Applicant: Agilent Technologies, Inc., Santa Clara, CA (US)

(72) Inventor: Curt A. Flory, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 14/470,077

(22) Filed: Aug. 27, 2014

(65) Prior Publication Data

US 2015/0279640 A1 Oct. 1, 2015

Related U.S. Application Data

(60) Provisional application No. 61/970,557, filed on Mar. 26, 2014.

(51) Int. Cl.

| | |
|---|---|
| ***H01J 49/00*** | (2006.01) |
| ***H01J 49/42*** | (2006.01) |
| ***H01J 49/02*** | (2006.01) |
| ***H01J 49/06*** | (2006.01) |
| ***H01J 49/26*** | (2006.01) |

(52) U.S. Cl.

CPC ..... *H01J 49/004* (2013.01); *H01J 49/0027* (2013.01); *H01J 49/025* (2013.01); *H01J 49/063* (2013.01); *H01J 49/26* (2013.01); *H01J 49/4285* (2013.01)

(58) Field of Classification Search

USPC ..... 250/281, 282, 283, 288

See application file for complete search history.

(56) References Cited

U.S. PATENT DOCUMENTS

| | | | | |
|---|---|---|---|---|
| 5,598,001 | A | 1/1997 | Flory et al. | |
| 5,672,870 | A | 9/1997 | Flory et al. | |
| 2010/0294923 | A1 * | 11/2010 | Kenny et al. | 250/282 |

FOREIGN PATENT DOCUMENTS

| | | | |
|---|---|---|---|
| WO | 2008090365 | A2 | 7/2008 |

OTHER PUBLICATIONS

Extended European Search Report, Aug. 6, 2015 (searched Jul. 30, 2015) for related EP Application No. 15 16 0787.

* cited by examiner

*Primary Examiner* — Nicole Ippolito
*Assistant Examiner* — Hanway Chang

(57) ABSTRACT

In a tandem mass spectrometry system, a first mass analyzer filters parent ions using a wide mass passband with a narrow rejection notch defined according to a modulation format. A wide mass range of parent ions is transmitted to an ion fragmentation device. Daughter ions produced thereby are transmitted to a second mass analyzer to produce a daughter ion mass spectrum. The modulation of the measured daughter ion mass spectrum, when correlated with the passband modulation of the first mass analyzer (i.e., parent ion spectrum), allows definitive identification of each daughter mass peak with the appropriate parent ion. Due to the wide mass passband, the ion detector signal is in proportion to the increased ion flux passed by the first mass analyzer.

20 Claims, 8 Drawing Sheets

METHODS AND APPARATUS FOR INCREASED ION THROUGHPUT IN TANDEM MASS SPECTROMETERS

RELATED APPLICATIONS

This application claims the benefit of U.S. Provisional Patent Application Ser. No. 61/970,557, filed Mar. 26, 2014, titled "METHOD AND APPARATUS FOR INCREASED ION THROUGHPUT IN TANDEM MASS SPECTROMETERS," the content of which is incorporated by reference herein in its entirety.

TECHNICAL FIELD

The present invention relates to tandem mass spectrometry (MS), and particularly to processing ions so as to increase ion throughput in a tandem MS system.

BACKGROUND

Mass spectrometry (MS) is an analytical technique utilized to produce spectra of the masses of ions produced from molecules of a sample of interest. The obtained spectra of masses are utilized to identify the molecules in the sample by correlating the measured masses with the known masses of ions associated with specific molecules. In a typical MS instrument, a sample is ionized, and the produced ions are subsequently separated in a mass analyzer according to their mass-to-charge ratio. The ions are detected by a mechanism capable of detecting charged particles (an ion detector), and the derived signal is displayed as a spectrum of the relative abundance of ions as a function of their mass-to-charge ratios (or m/z values, or more simply "masses").

Tandem mass spectrometry (MS-MS) is an analytical technique that utilizes multiple stages of mass spectrometry, which are usually separated by some form of ion fragmentation device such as a collision cell. MS-MS can be utilized to produce structural information about a compound by fragmenting specific ions inside the mass spectrometer and identifying the resulting fragment ions. This information can then be pieced together to generate structural information about the intact molecule. A typical tandem mass spectrometer has two mass analyzers separated by a collision cell into which an inert gas (e.g., argon, nitrogen) is admitted to collide with the selected sample of ions, causing the desired fragmentation. The mass analyzers can be of the same or different types, the most common combinations being quadrupole-quadrupole and quadrupole-time-of-flight.

In typical applications of MS-MS, the sample of the material to be analyzed is a complex mixture of many distinct molecular species. The first mass analyzer stage is used to select a range of ion masses to transmit to the collision cell for fragmentation. Conventionally, this first stage is required to transmit only a limited number of molecular species ("precursor" or "parent" ions) so that after fragmentation the resulting mass spectrum ("product" or "daughter" ions) is simple enough that daughter mass peaks can be identified with the correct parent ion. Clearly, if many different species of parent ions were transmitted through the first mass analyzer and subsequently passed through the collision cell, the resulting spectrum of daughter ions appearing at the final mass analyzer stage would have a complexity that would preclude this identification.

This requirement that the first mass analyzer stage in MS-MS applications pass only a limited range of mass-to-charge ratios at a given time can be an undesirable restriction. Specifically, when the MS-MS system is being utilized in tandem with a real-time analytical separation process such as a chromatographic separation process, the chromatographic time-scale may not allow sufficient time for the MS-MS system to step through the many (narrow) mass windows required to adequately analyze the eluting sample material at a particular time. A related problem is that most of the ions entering the MS-MS system do not make it past the first mass analyzer stage as the full mass range is scanned with a narrow mass window. This has a negative impact on abundance sensitivity in applications where there is limited access time to a particular sample, or the total amount of available sample is small.

To mitigate these restrictions, there is a need for methods and apparatuses that would allow a greater fraction of the ions to pass through the first mass analyzer stage at any given time, and still allow the complex spectrum of daughter ions to be disentangled, and uniquely identify daughter ion peaks with the correct parent ion.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a tandem mass spectrometry (MS) system includes: a first mass analyzer configured for receiving a plurality of parent ions spanning a full parent mass range, wherein the full parent mass range comprises N parent mass sub-ranges; an ion fragmentation device; a second mass analyzer; an ion detector; and a computing device configured for: controlling the first mass analyzer, the ion fragmentation device, the second mass analyzer, and the ion detector according to a modulation format comprising the following steps: (i) in a first iteration, transmitting a first packet of the parent ions received by the first mass analyzer to a fragmentation device, wherein the first packet spans the full parent mass range except for a first rejected sub-range, the first rejected sub-range being one of the N parent mass sub-ranges; (ii) fragmenting the parent ions of the first packet to produce a plurality of first daughter ions; (iii) measuring the first daughter ions to acquire first daughter spectral data; (iv) repeating steps (i) to (iii) for at least (N−1) additional iterations wherein, in each additional iteration, a new packet of the parent ions is transmitted to the fragmentation device, the new packet spans the full parent mass range except for a new rejected sub-range different from rejected sub-range of the first iteration and of any other previous iteration, the new packet is fragmented to produce a plurality of new daughter ions, and the new daughter ions are measured to acquire new daughter spectral data; selecting one of the N parent mass sub-ranges; and associating a group of measured daughter ions from the acquired daughter spectral data with the selected parent mass sub-range, wherein the group corresponds to daughter ions produced from parent ions of the selected parent mass sub-range.

According to another embodiment, a method for performing tandem mass spectrometry includes: (a) ionizing a sample to produce a plurality of parent ions spanning a full parent mass range, wherein the full parent mass range comprises N parent mass sub-ranges; (b) in a first iteration, transmitting a first packet of the parent ions to a fragmentation device, wherein the first packet spans the full parent mass range except for a first rejected sub-range, the first rejected sub-range being one of the N parent mass sub-ranges; (c) fragmenting the parent ions of the first packet to produce a plurality of first daughter ions; (d) measuring the first daughter ions to acquire first daughter spectral data; (e) repeating steps (b) to (d) for at least (N−1) additional iterations wherein, in each additional iteration, a new packet of the parent ions is transmitted to the fragmentation device, the new packet spans the full parent mass range except for a new rejected sub-range different from rejected sub-range of the first iteration and of any other previous iteration, the new packet is fragmented to produce a plurality of new daughter ions, and the new daughter ions are measured to acquire new daughter spectral data; (f) selecting one of the N parent mass sub-ranges; and (g) associating a group of measured daughter ions from the acquired daughter spectral data with the selected parent mass sub-range, wherein the group corresponds to daughter ions produced from parent ions of the selected parent mass sub-range.

According to another embodiment, a spectrometry system is configured for performing all or part of any of the methods disclosed herein.

According to another embodiment, a system for performing tandem mass spectrometry includes: a processor and a memory configured for performing all or part of any of the methods disclosed herein.

According to another embodiment, a computer-readable storage medium includes instructions for performing all or part of any of the methods disclosed herein.

According to another embodiment, a system includes the computer-readable storage medium.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
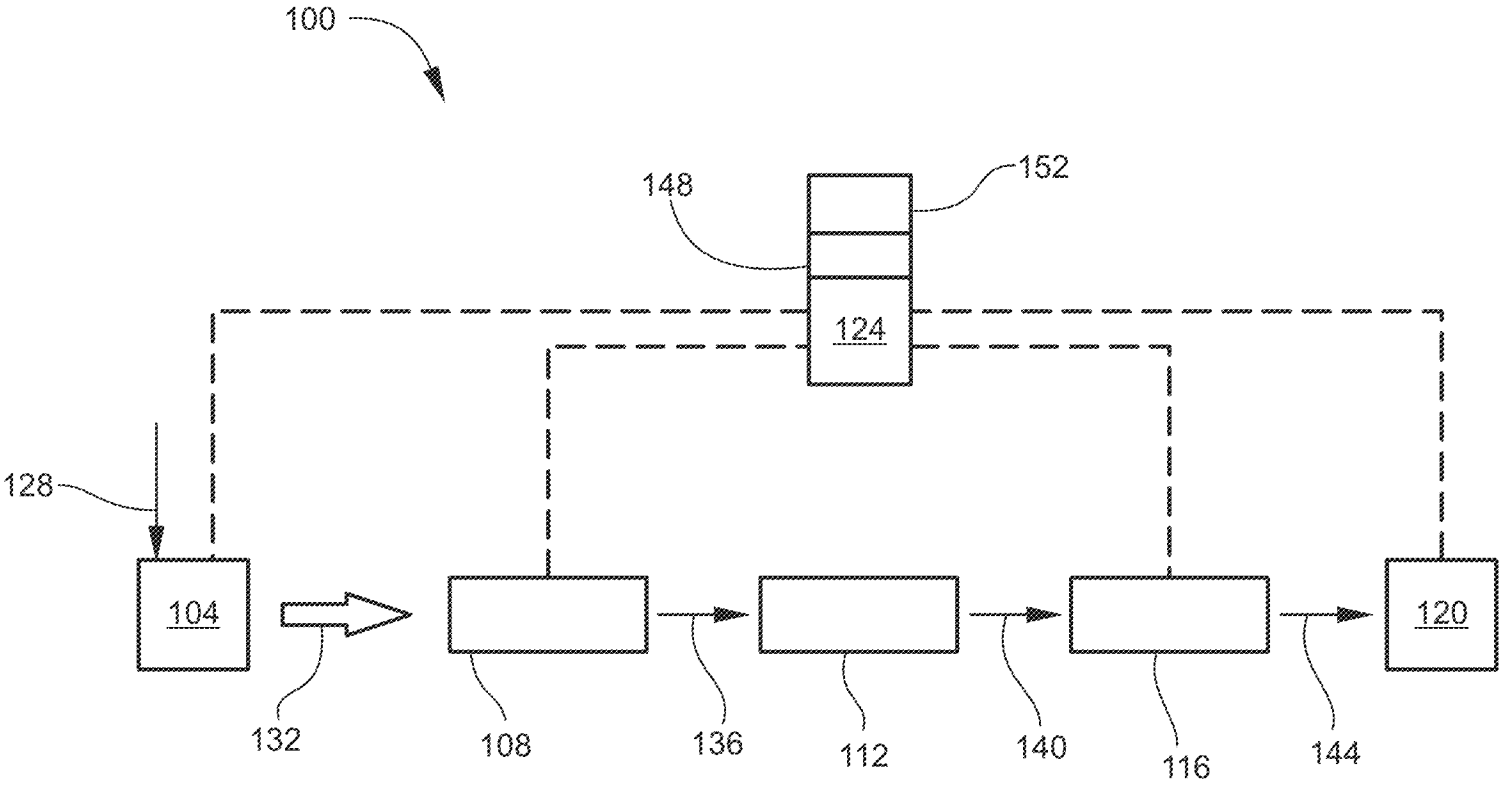
FIG. 1A is a schematic view of an example of a mass spectrometry (MS) system configured for performing tandem MS (MS-MS) according to some embodiments.

FIG. 1A is a schematic view of an example of a mass spectrometry (MS) system 100 configured for performing tandem MS (MS-MS) according to some embodiments. The operation and design of various components of mass spectrometry systems are generally known to persons skilled in the art and thus need not be described in detail herein. Instead, certain components are briefly described to facilitate an understanding of the subject matter presently disclosed.

The MS system 100 may generally include an ion source 104, a first mass analyzer 108, an ion fragmentation device 112, a second mass analyzer 116, an ion detector 120, and a computing device (or system controller) 124. From the perspective of FIG. 1A, the MS system 100 defines a flow path for ions and gas molecules successively through the foregoing devices generally in the direction from left to right. Each device includes one or more internal chambers communicating with a vacuum system (not shown) of the MS system 100. The chambers serve as pressure-reducing stages, successively pumping down the gas pressure to the very low operating pressure (high vacuum) of the second mass analyzer 116. One exception is that the ion fragmentation device 112 when configured for collision induced dissociation (CID) may operate at a higher pressure than the preceding first mass analyzer 108, although in such a case will be followed by one or more pressure-reducing stages in front of the second mass analyzer 116. For simplicity, additional ion processing devices, ion optics, electronics, and other hardware that may be required for operation of the MS system 100 are not shown. In some embodiments, the MS system 100 may include an ion mobility analyzing stage (not shown) as appreciated by persons skilled in the art.

The ion source 104 may be any type of continuous-beam or pulsed ion source suitable for producing analyte ions for mass spectral analysis. Depending on design, the ion source 104 may operate at or near atmospheric pressure, or at vacuum. The ion source 104 includes an ionization chamber in which sample molecules are broken down to analyte ions by an ionization device (not shown). The sample to be ionized may be introduced to the ion source 104 by any suitable means, including hyphenated techniques in which the sample is an output 128 of an analytical separation instrument such as, for example, a gas chromatography (GC) or liquid chromatography (LC) instrument (not shown). The ion source 104 may also include other components (electrodes, ion optics, etc., not shown) useful for organizing as-produced analyte ions into an analyte ion beam 132 that may be efficiently transmitted into the first mass analyzer 108.

The first mass analyzer 108 generally may be any device capable of operating as a mass filter that transmits a mass-selected parent ion beam 136 into the ion fragmentation device 112. That is, the mass analyzer 108 may receive the full mass range of analyte ions produced in the ion source 104, filter out unwanted ion masses, and transmit only the mass range selected for use as parent ions (precursor ions) in the tandem MS analysis. For this purpose, in some embodiments the first mass analyzer 108 may be or include a linear (two-dimensional) multipole ion guide (e.g., quadrupole, hexapole, octopole, etc.) or an ion funnel. Examples of operating a quadrupole mass analyzer are described below.

The ion fragmentation device 112 generally may be any device capable of fragmenting parent ions into daughter ions (also termed product ions, or fragment ions) and transmitting a daughter ion beam 140 into the second mass analyzer 116. In some embodiments, the ion fragmentation device 112 may be or include a non-mass-resolving, radio frequency-only (RF-only), linear multipole ion guide configured as a collision cell. In such a case, the collision cell is pressurized with an inert buffer gas (e.g., argon, nitrogen, etc.), with the pressure maintained at a level effective for inducing collision induced dissociation (CID). In CID, parent ions collide with the buffer gas molecules with enough energy to fragment into daughter ions.

While it is possible in some embodiments that more than one generation of fragmentation may occur, for purposes of the present disclosure no distinction is made between different generations. Thus, the term "daughter" ions may also encompass "granddaughter" ions, etc. In other embodiments, the ion fragmentation device 112 may be configured for implementing other types of fragmenting mechanisms such as, for example, electron capture dissociation (ECD), electron transfer dissociation (ETD), or infrared multiphoton dissociation (IRMPD).

The second mass analyzer 116 generally may be any device capable of resolving daughter ions on the basis of mass and transmitting mass-resolved daughter ions 144 to the ion detector 120. In some embodiments, the second mass analyzer 116 may be or include a linear multipole mass analyzer (or mass filter) or a time-of-flight (TOF) analyzer. Thus, in some embodiments the MS system 100 may include the well-known QqQ (triple-quad) or QqTOF configuration. Other examples of configurations of the second mass analyzer 116 include, but are not limited to, an ion trap (e.g., a two-dimensional or three-dimensional Paul trap), an ion cyclotron resonance (ICR) cell (or Penning cell), an electrostatic ion trap, or a static electric and/or magnetic sector analyzer.

The computing device 124 is schematically depicted as representing one or more modules (or units, or components) configured for controlling, monitoring and/or timing various functional aspects of the MS system 100 such as, for example, the ion source 104, the first mass analyzer 108, the ion fragmentation device 112, the second mass analyzer 116, and the ion detector 120, as well as any vacuum pumps, ion optics, upstream LC or GC instrument, sample introduction device, etc., that may be provided in the MS system 100 but not specifically shown in FIG. 1A. One or more modules (or units, or components) may be, or be embodied in, for example, a desktop computer, laptop computer, portable computer, tablet computer, handheld computer, mobile computing device, personal digital assistant (PDA), smartphone, etc. The computing device 124 may also schematically represent all voltage sources not specifically shown, as well as timing controllers, clocks, frequency/waveform generators and the like as needed for applying appropriate signals and power to various components of the MS system 100. The computing device 124 may also be configured for receiving the ion detection signals from the ion detector 120 and performing tasks relating to data acquisition and signal analysis as necessary to generate mass (m/z ratio) spectra characterizing the sample under analysis. The computing device 124 may also be configured for providing and controlling a user interface that provides screen displays of spectrometric data and other data with which a user may interact. The computing device 124 may include one or more reading devices on or in which a tangible computer-readable (machine-readable) medium may be loaded that includes instructions for performing all or part of any of the methods disclosed herein. For all such purposes, the computing device 124 may be in signal communication with various components of the MS system 100 via wired or wireless communication links (as partially represented, for example, by dashed lines in FIG. 1A). Also for these purposes, the computing device 124 may include one or more types of hardware, firmware and/or software, as well as one or more memories and databases.

The computing device 124 may include one or more modules (or units, or components) configured for performing specific data acquisition or signal processing functions. In some embodiments, these modules may include a beam modulator 148 configured for controlling the filtering function of the first mass analyzer 108, and a demodulator or correlator 152 configured for identifying and associating specific daughter ion mass peaks with corresponding parent ions. These modules are described further below.

Figure 1B:
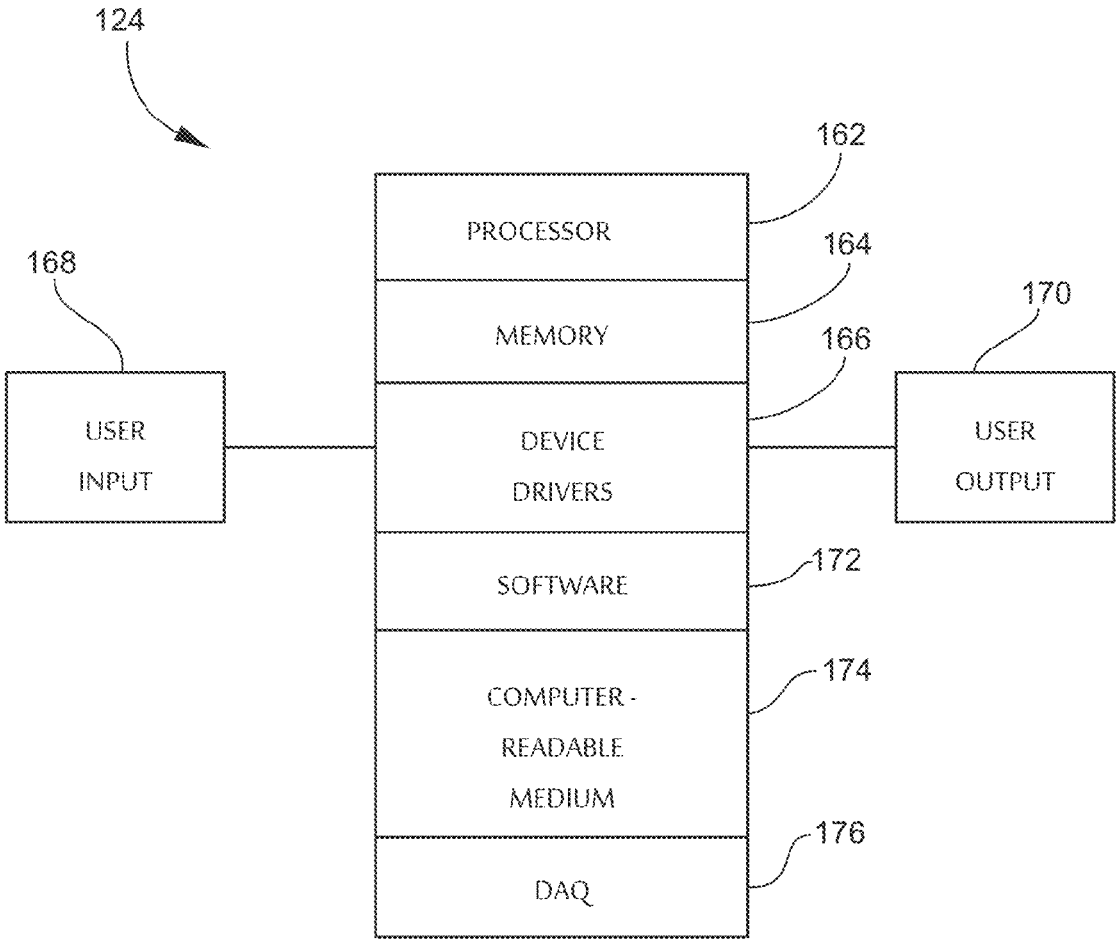
FIG. 1B is a schematic view of a non-limiting example of a computing device that may operate with the MS system illustrated in FIG. 1A according to some embodiments.

FIG. 1B is a schematic view of a non-limiting example of the computing device 124 according to some embodiments. In the illustrated embodiment the computing device 124 includes a processor 162 (typically electronics-based), which may be representative of a main electronic processor providing overall control, and one or more electronic processors configured for dedicated control operations or specific signal processing tasks (e.g., a graphics processing unit, or GPU). The computing device 124 also includes one or more memories 164 (volatile and/or non-volatile) for storing data and/or software. The computing device 124 may also include one or more device drivers 166 for controlling one or more types of user interface devices and providing an interface between the user interface devices and components of the computing device 124 communicating with the user interface devices. Such user interface devices may include user input devices 168 (e.g., keyboard, keypad, touch screen, mouse, joystick, trackball, and the like) and user output devices 170 (e.g., display screen, printer, visual indicators or alerts, audible indicators or alerts, and the like). In various embodiments, the computing device 124 may be considered as including one or more user input devices 168 and/or user output devices 170, or at least as communicating with them. The computing device 124 may also include one or more types of computer programs or software 172 contained in memory and/or on one or more types of computer-readable media 174. Computer programs or software may contain instructions (e.g., logic instructions) for performing all or part of any of the methods disclosed herein. Computer programs or software may include application software and system software. System software may include an operating system (e.g., a Microsoft Windows® operating system) for controlling and managing various functions of the computing device 124, including interaction between hardware and application software. In particular, the operating system may provide a graphical user interface (GUI) displayable via a user output device 170 such as a display screen, and with which a user may interact with the use of a user input device 168 such as a keyboard or a pointing device (e.g., mouse). The computing device 124 may also include one or more data acquisition/signal conditioning components 176 (as may be embodied in hardware, firmware and/or software) for receiving and processing ion measurement signals outputted by the ion detector 150, including formatting data for presentation in graphical form by the GUI. The data acquisition/signal conditioning components 176 may include signal processing modules such as the beam modulator 148 and correlator 152 noted above (FIG. 1A) and described in further detail below.

It will be understood that FIGS. 1A and 1B are high-level schematic depictions of an example of an MS system 100 and associated computing device 124 consistent with the present disclosure. Other components, such as additional structures, vacuum pumps, gas plumbing, ion optics, ion guides, electronics, and computer- or electronic processor-related components may be included as needed for practical implementations. It will also be understood that the computing device 124 is schematically represented in FIGS. 1A and 1B as functional blocks intended to represent structures (e.g., circuitries, mechanisms, hardware, firmware, software, etc.) that may be provided. The various functional blocks and signal links have been arbitrarily located for purposes of illustration only and are not limiting in any manner. Persons skilled in the art will appreciate that, in practice, the functions of the computing device 124 may be implemented in a variety of ways and not necessarily in the exact manner illustrated in FIGS. 1A and 1B and described herein.

In operation, a sample is introduced to the ion source 104. The ion source 104 produces sample ions (analyte ions and background ions) from the sample and transfers the ions to the first mass analyzer 108. The first mass analyzer 108 selects a limited subset of ion species that comprise the parent ions to be analyzed. These parent ions are directed to the ion fragmentation device 112 where they undergo CID or other fragmentation technique. The resulting fragments, or daughter ions, are then directed to the second mass analyzer 116. The second mass analyzer 116 mass-resolves the daughter ions and transmits them to the ion detector 120. The measurement signals outputted from the ion detector 120 are processed by electronics of the MS system 100 to produce mass spectra. The mass peaks measured by the second mass analyzer 116 are identified as daughter ions derived from specific intact parent ions by system software executed by the computing device 124.

Figure 2:
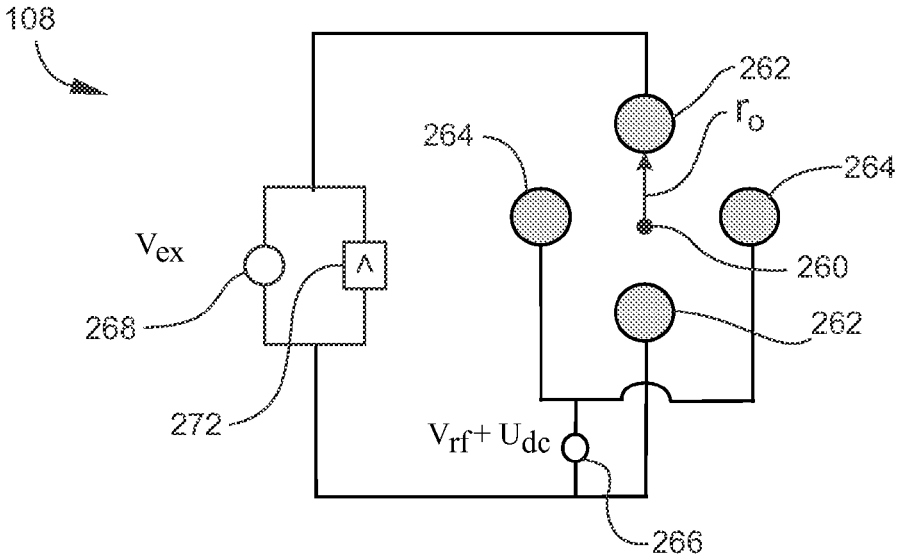
FIG. 2 is a schematic cross-sectional view of a first-stage mass analyzer, in the transverse plane orthogonal to an axis along which ions flow.

The mass range of parent ions selected by the first mass analyzer 108 is determined by the voltage parameters applied to the multipole electrode set of the first mass analyzer 108. FIG. 2 is a schematic cross-sectional view of the first mass analyzer 108, in the transverse plane orthogonal to a longitudinal axis 260 along which ions flow (the horizontal axis in FIG. 1A). The first mass analyzer 108 may include a plurality of ion guide electrodes elongated along the longitudinal axis 260 and circumferentially spaced about the longitudinal axis 260. By this configuration, the ion guide electrodes surround an axially elongated ion guide volume of inscribed radius $r_0$ in which ions may be radially confined. In the illustrated embodiment, the ion guide electrodes are arranged as a quadrupole comprising a first opposing pair of electrically interconnected ion guide electrodes 262 and a second opposing pair of electrically interconnected ion guide electrodes 264. Other embodiments may provide other multipole arrangements, such as hexapole arrangements, octopole arrangements, etc.

The first mass analyzer 108 may also include a first RF voltage source 266 communicating with the ion guide electrodes 262 and 264. The first RF voltage source 266 applies an RF confining voltage of the general form $V_{RF}=\cos(\Omega t)$ to the ion guide electrodes 262 and 264, where $V_{RF}$ is the amplitude and $\Omega$ is the RF drive frequency. The phase $\phi$ of the RF voltage applied to one opposing pair of ion guide electrodes 262 is shifted 180 degrees from the phase applied to the other opposing pair of ion guide electrodes 264. More generally for multipole arrangements, the RF phase applied to any given electrode is shifted 180 degrees from the RF phase applied to the adjacent electrodes on either side of the given electrode. Consequently, the ion guide electrodes 262 and 264 generate a two-dimensional, multipole RF radial confining field of Nth order, where N is an integer equal to or greater than 2. In the illustrated embodiment, the ion guide electrodes 262 and 264 generate a quadrupole field (N=2). Other examples of Nth order RF fields include, but are not limited to, hexapole fields (N=3), octopole fields (N=4), etc. The voltage parameters $V_{RF}$ and $\Omega$ of the first RF voltage source 266 determine the mass range of ions that will have stable trajectories in the radial confining field. Stable ions are able to drift through the first mass analyzer 108 along the longitudinal axis 260 and be transmitted into the ion fragmentation device 112, whereas unstable ions are able to oscillate far enough in the radial directions to reach the ion guide electrodes 262 and 264 and be lost. In some embodiments, the voltage parameters may be set to collect as wide a mass range of analyte ions produced in the ion source 104 as possible, while rejecting background (non-analyte) ions such as solvent ions, carrier gas ions, etc. In some embodiments, a direct current (DC) voltage $U_{DC}$ of desired magnitude may be superimposed on the RF quadrupole voltage $V_{RF}$ such that the RF confining field is a composite RF/DC field, which may be done to tailor the stable mass range as desired, as appreciated by persons skilled in the art. Thus, for convenience the term "first RF voltage source" 266 encompasses a device that supplies either an RF-only voltage or an RF/DC voltage, and the term "RF confining field" (or "RF quadrupole voltage," or like terms) encompasses either an RF-only confining field (or "RF-only quadrupole voltage," or like terms) or an RF/DC confining field (or "RF/DC quadrupole voltage," or like terms).

The first mass analyzer 108 is configured to operate as a mass bandpass filter that determines which ion masses are transmitted into the ion fragmentation device 112 and which ion masses are rejected and thus not transmitted into the ion fragmentation device 112. Conventionally, the applied RF and DC voltages are selected to produce a narrow m/z passband that allows transmission of the desired subset of parent ions. The voltage parameters are "step-wise varied" to sequentially cover the desired full mass range of interest, as depicted in Figures FIGS. 3A to 3D, or they may be varied to sequentially transmit several parent-mass ranges of interest. FIGS. 3A to 3D illustrate an example of varying (or scanning) a narrow m/z passband in a step-wise manner according to a conventional technique. Specifically FIGS. 3A to 3D are a set of plots of the narrow m/z passband, represented as transmission probability as a function of m/z ratio, at different iterations of the measurement process. In each of FIGS. 3A to 3D, the horizontal, double-headed arrow spans the extent of the total mass range of ions confined by the first mass analyzer 108. The narrow m/z passband may be varied by varying the amplitude $V_{RF}$ or the drive frequency $\Omega$ of the RF quadrupole voltage.

Figure 3:
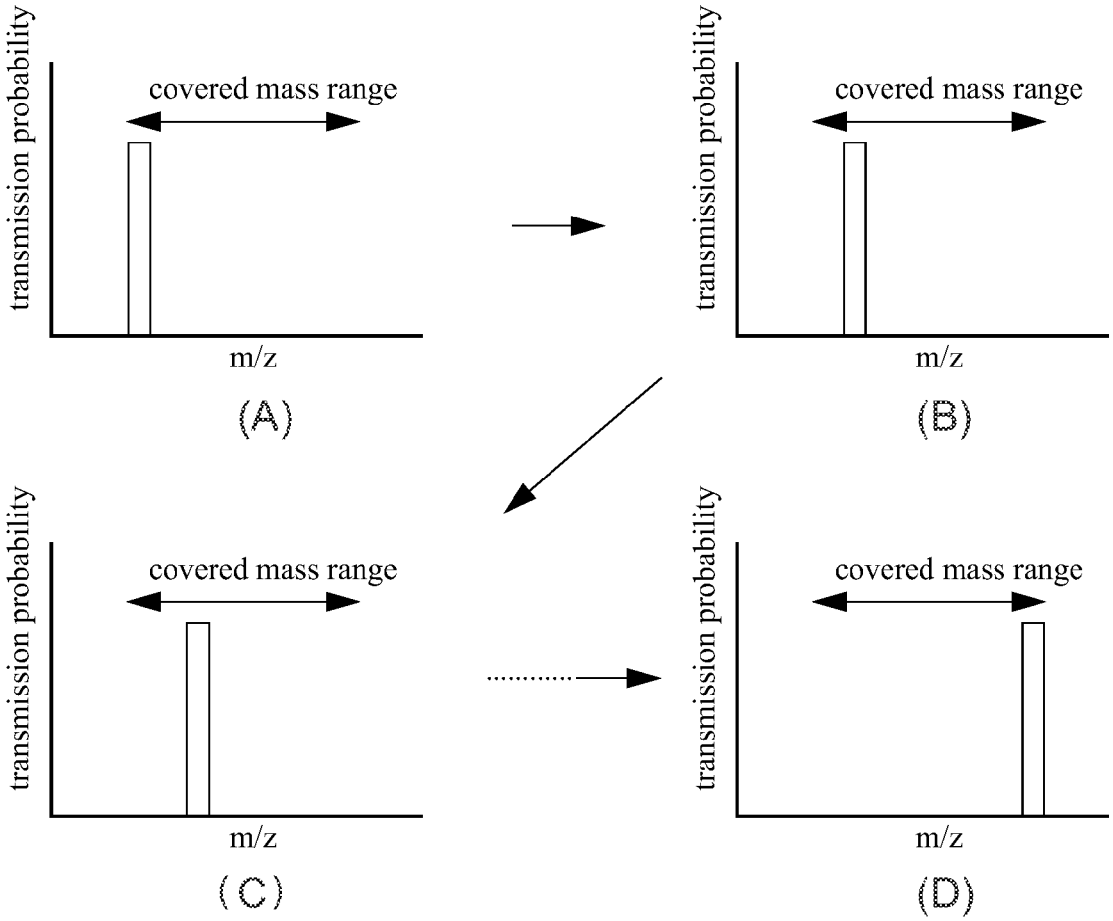
FIG. 3 (PRIOR ART)
FIGS. 3A, 3B, 3C, and 3D illustrate an example of varying (or scanning) a narrow m/z passband in a step-wise manner in a first-stage mass analyzer according to a conventional technique.
Figure 4:
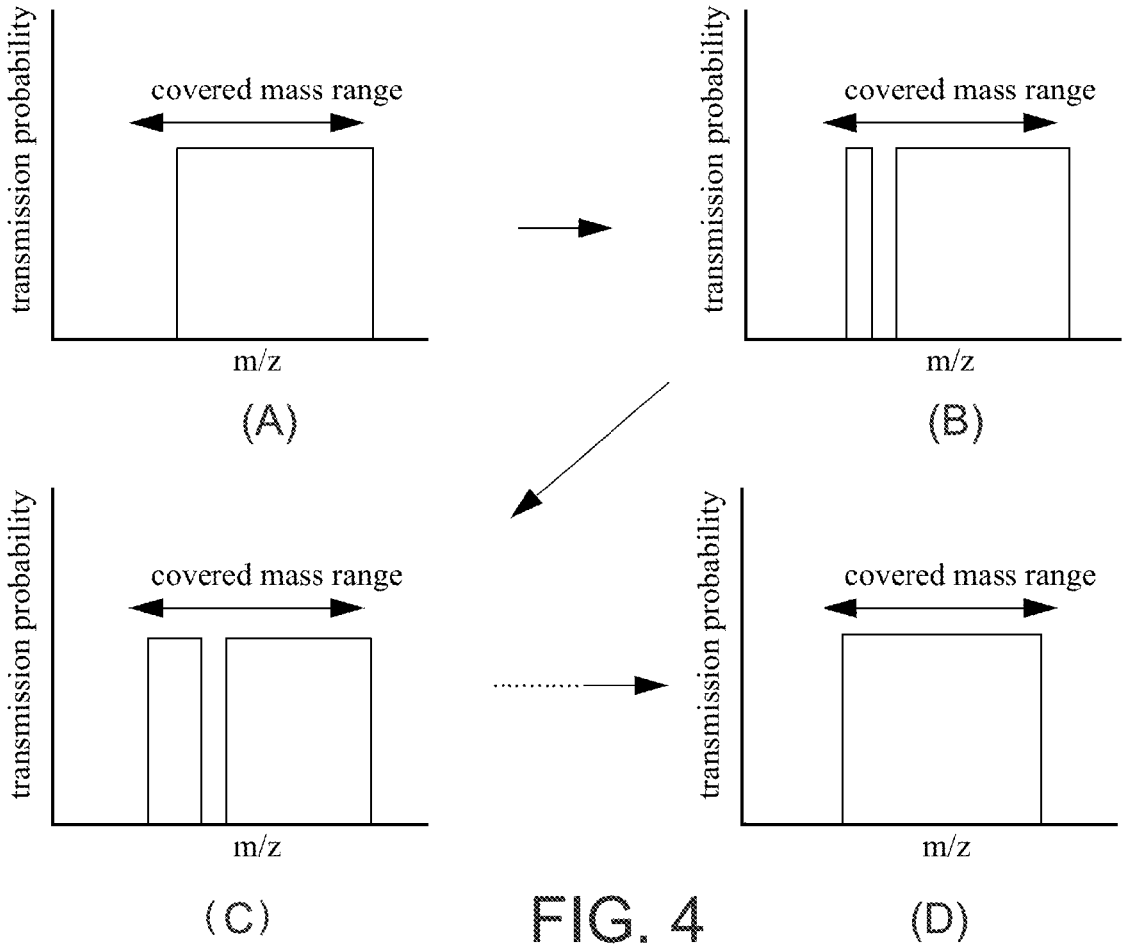
FIGS. 4A, 4B, 4C, and 4D illustrate an example of a format for sequential shape-modulation of a wide m/z passband in a first-stage mass analyzer according to some embodiments.

FIG. 3A shows the initial iteration, in which the passband covers the lowest range of parent ion masses. Ions in this lowest mass range are thus transmitted from the first mass analyzer 108 to the ion fragmentation device 112 and fragmented into daughter ions. The daughter ions are then transmitted to the second mass analyzer 116, sorted by mass, and measured by the ion detector 120 as described above. Meanwhile, all of the other ions initially transmitted into the first mass analyzer 108 (in the mass range spanning the rest of the area under the double-headed arrow to the right of the passband) are lost and thus do not contribute to the ion signal utilized to produce mass spectra. After the initial iteration, another packet of analyte ions covering the full mass range of the ionized sample may be transmitted into the first mass analyzer 108 from the ion source 104. FIGS. 3B and 3C show the next two iterations of mass filtering. It is seen that the voltage parameters are adjusted so as to successively move the passband to higher mass ranges. In each iteration, only ions in the passband are transmitted, while ions of lower or higher masses on either side of the passband are lost. FIG. 3D shows the final iteration, in which parent ions of the highest range are transmitted while all of the lower mass ions (in the mass range spanning the rest of the area under the double-headed arrow to the left of the passband) are lost. It can be seen that if the narrow passbands are considered as constituting N different mass windows covering the entire mass range of interest, only 1/N of the total analyte ions made available by the ion source 104 are actually analyzed by the MS system 100 in a given experiment.

According to embodiments disclosed herein, the MS system 100 may be configured to allow a much greater fraction of the analyte ions to contribute to the detected signal, and yet still disentangle the complex spectrum of fragment daughter ions and associate them with the parent ions from which they were derived. This may be achieved by operating the first mass analyzer 108 with a substantially wider m/z passband, and which is shape-modulated in a pre-determined way for each of the N steps of the measurement process. The modulation of the measured daughter ion mass spectrum, when correlated with the passband modulation of the first mass analyzer 108 (i.e., parent ion spectrum), allows definitive identification of each daughter mass peak with the appropriate parent ion. In this way, all ion detector signals are increased in proportion to the increased ion flux passed by the first mass analyzer 108.

Figure 5:
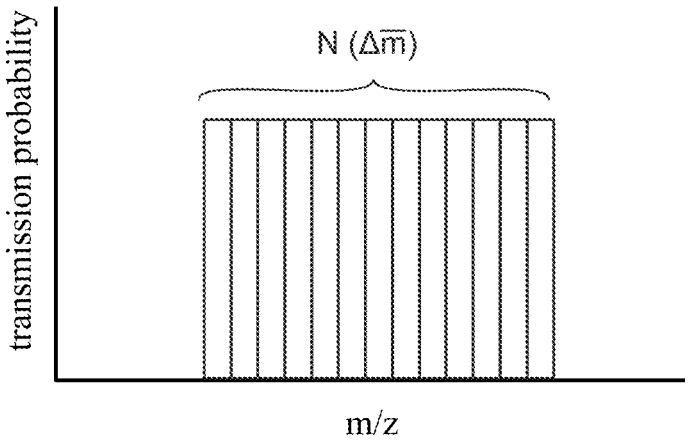
FIG. 5 illustrates a full m/z passband divided into N subregions, or "mass windows" according to some embodiments.

FIGS. 4A to 4D illustrate an example of a format for sequential shape-modulation of the m/z passband of the first mass analyzer 108 according to some embodiments. The modulation format entails establishing a wide m/z passband over the full mass range of interest, and a narrow "rejection notch" (or "transmission null") that is sequentially stepped across the full mass range during the measurement process. Specifically FIGS. 4A to 4D are a set of plots of the wide m/z passband, represented as transmission probability as a function of m/z ratio, at different iterations of the measurement process. Like FIGS. 3A to 3D, the horizontal, double-headed arrow spans the extent of the total mass range of ions confined by the first mass analyzer 108. During each iteration, most or all of the ions in the specified narrow rejection notch are removed from the first mass analyzer 108, while all of the other ions in the specified larger-range passband are transmitted. While other modulation sequences are possible, the one described in FIGS. 4A to 4D is particularly simple and can be quickly analyzed to demonstrate the efficacy of the technique disclosed herein. For analysis purposes, it is assumed that the full m/z range of interest can be broken up into N subregions (herein called "windows") of width $\Delta\overline{m}$, as shown in FIG. 5. Although in FIG. 5 the N subregions are of equal width $\Delta\overline{m}$, they need not be, so long as the sum of the N subregions equals the total parent mass range being processed. The measurement procedure is to sequentially apply appropriate voltage parameters to the first mass analyzer 108, which has a nominal passband over the full m/z range of interest, and sequentially create N rejection notches (transmission nulls) of width $\Delta\overline{m}$ at (equal or non-equal) intervals across the passband, as depicted in FIGS. 4A to 4D. In some embodiments, the width $\Delta\overline{m}$ is in a range from 1 amu to 50 amu.

As one non-limiting example, a resonant excision technique may be utilized to implement the tunable rejection notch or transmission null. For this purpose, the first mass analyzer 108 may include a second RF voltage source 268 communicating with one opposing pair of ion guide electrodes 262, as shown in FIG. 2. The second RF voltage source 268 applies an RF excision voltage of the general form $V_{EX}=\cos(\omega t)$ to the ion guide electrodes 262. This has the effect of generating an auxiliary (or supplemental) RF dipole field superimposed on the main RF (or RF/DC) confining field, with the dipole oriented along the transverse axis common to the two ion guide electrodes 262. As schematically shown in FIG. 2, the excision voltage is necessarily shunted by an electrical filter 272 that passes the RF quadrupole voltage $V_{RF}$, allowing the generation of the normal quadrupole voltages. The dipolar field "excision" frequency $\omega$ is selected to correspond to (match up with) the specific transverse (macromotion) frequency (or secular frequency) of the ion to be eliminated, and is lower than the drive frequency $\Omega$ of the RF (or RF/DC) confining field. This transverse frequency is determined from the effective potential generated by the high frequency RF quadrupole fields as the ions are guided along the length of the first mass analyzer 108, and depends upon the m/z ratio of the ion. The (lower frequency) dipole excision field coherently acts (through resonant energy coupling) to increase the transverse motional amplitude of the ion to be eliminated as it "bounces" down the ion guide volume inscribed by the ion guide electrodes 262 and 264, until the motional amplitude of the ion becomes so large that the ion strikes the mutlipole electrode structure and is thereby eliminated from the radially confined ion beam. Without the dipole excision field, this ion would otherwise be stable, remaining radially confined in the ion phase space along the longitudinal axis 260 and eventually being transmitted out from the exit end of the first mass analyzer 108. Meanwhile, the lack of synchronism (resonance condition) of the dipole field's excision frequency with the transverse bounce frequencies of ions with different mass-to-charge ratios is such that their motional amplitudes do not increase significantly and they remain radially confined in the ion phase space. In this manner, mass sensitivity and narrow-band rejection is achieved. The rejection notch may be tuned (i.e., changed or adjusted), or shifted along the m/z axis (FIGS. 4A to 4D) by varying (changing or adjusting) the excision frequency so that it matches up with the secular frequencies of other ion masses.

Thus, the first mass analyzer 108 may be configured for generating a radio frequency (RF) (or RF/DC) multipole confining field that establishes a passband through which ions are transmitted to the ion fragmentation device 112, and an RF excision field that establishes a rejection notch in the passband. The first mass analyzer 108 may be configured for applying the RF (or RF/DC) multipole confining field at a first frequency, and for applying the RF excision field at a second frequency lower than the first frequency. In some embodiments, the first frequency is in a range of 100 KHz to 10 MHz, and the second frequency is in a range of 20 KHz to 5 MHz. In some embodiments, the second frequency is in a range of 20% to 50% of the first frequency. Other ranges for the first frequency and second frequency may be suitable in alternative embodiments. In some embodiments, the first mass analyzer 108 may be configured for applying the RF multipole confining field at a first peak amplitude in a range of 500 V to 5000 V, and for applying the RF excision field at a second peak amplitude in a range of 1 V to 1000 V. In some embodiments, the second peak amplitude is in a range of 0.02% to 20% of the first peak amplitude. Other ranges for the first peak amplitude and second peak amplitude may be suitable in alternative embodiments.

Notch filters are also described in U.S. Pat. Nos. 5,598,001 and 5,672,870, the contents of both of which are incorporated by reference herein. As an alternative to the dipole excision field, a quadrupole excision field as described in U.S. Pat. No.

5,672,870 may be utilized (such as by applying the RF excision voltage also to the other pair of electrodes 264 shown in FIG. 2), but a quadrupole excision field is typically much less efficient. More generally, the present subject matter is not limited to the use of resonant excision fields, but instead may encompass any other approach that achieves similar results.

Figure 6:
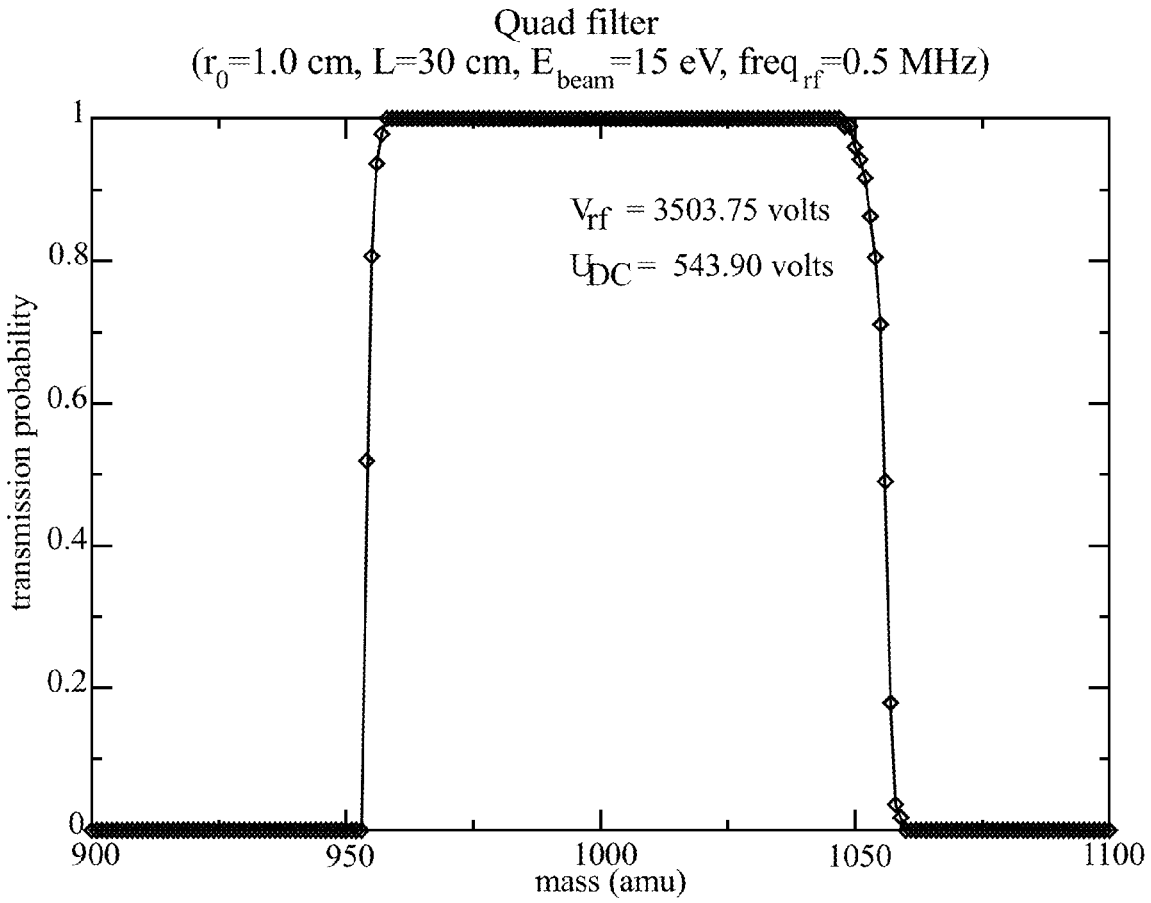
FIG. 6 illustrates the calculated form of a nominal wide passband (depicted as a plot of transmission probability as a function of mass (amu)) with no applied excision voltage.
Figure 7:
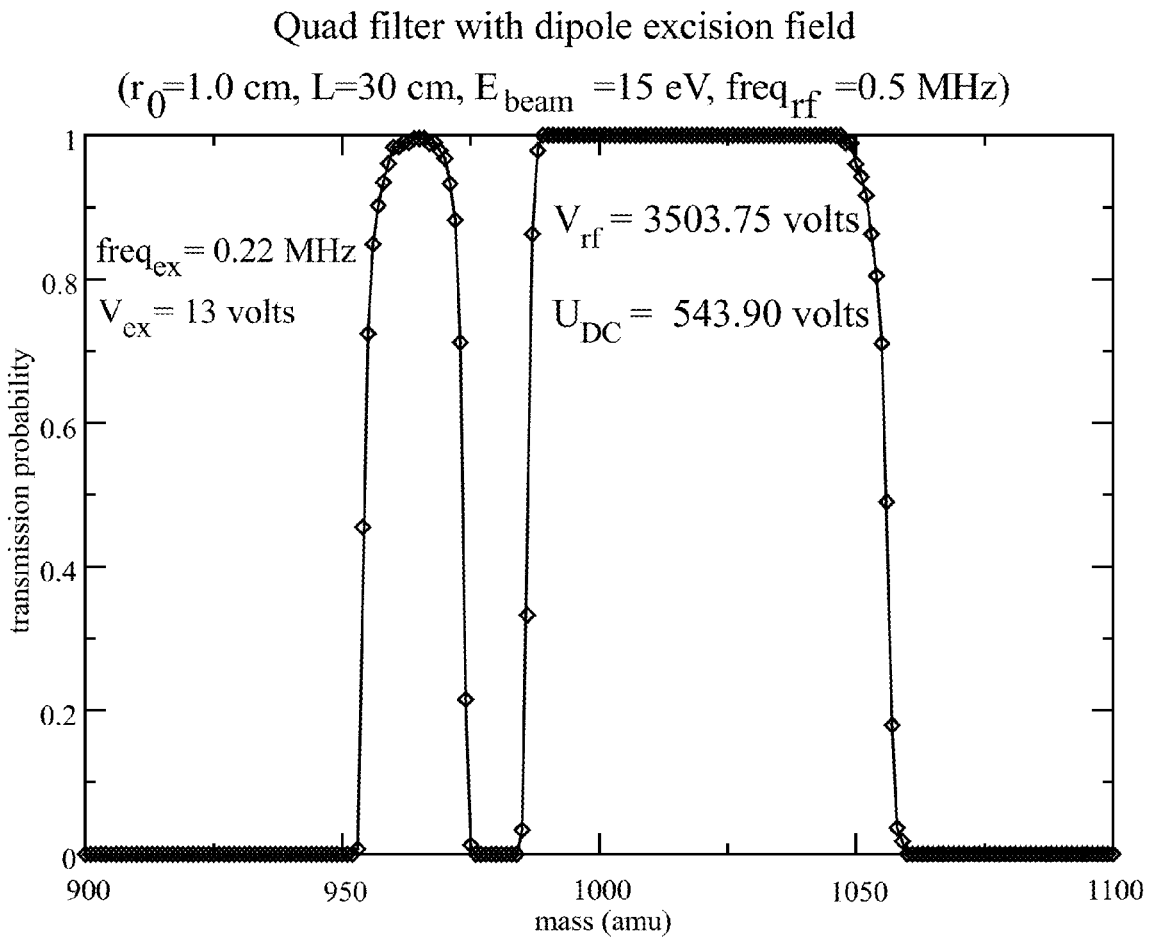
FIG. 7 illustrates the calculated form of the passband illustrated in FIG. 6 when an excision voltage is applied as disclosed herein, which produces a narrow m/z rejection notch in the wide passband.
Figure 8:
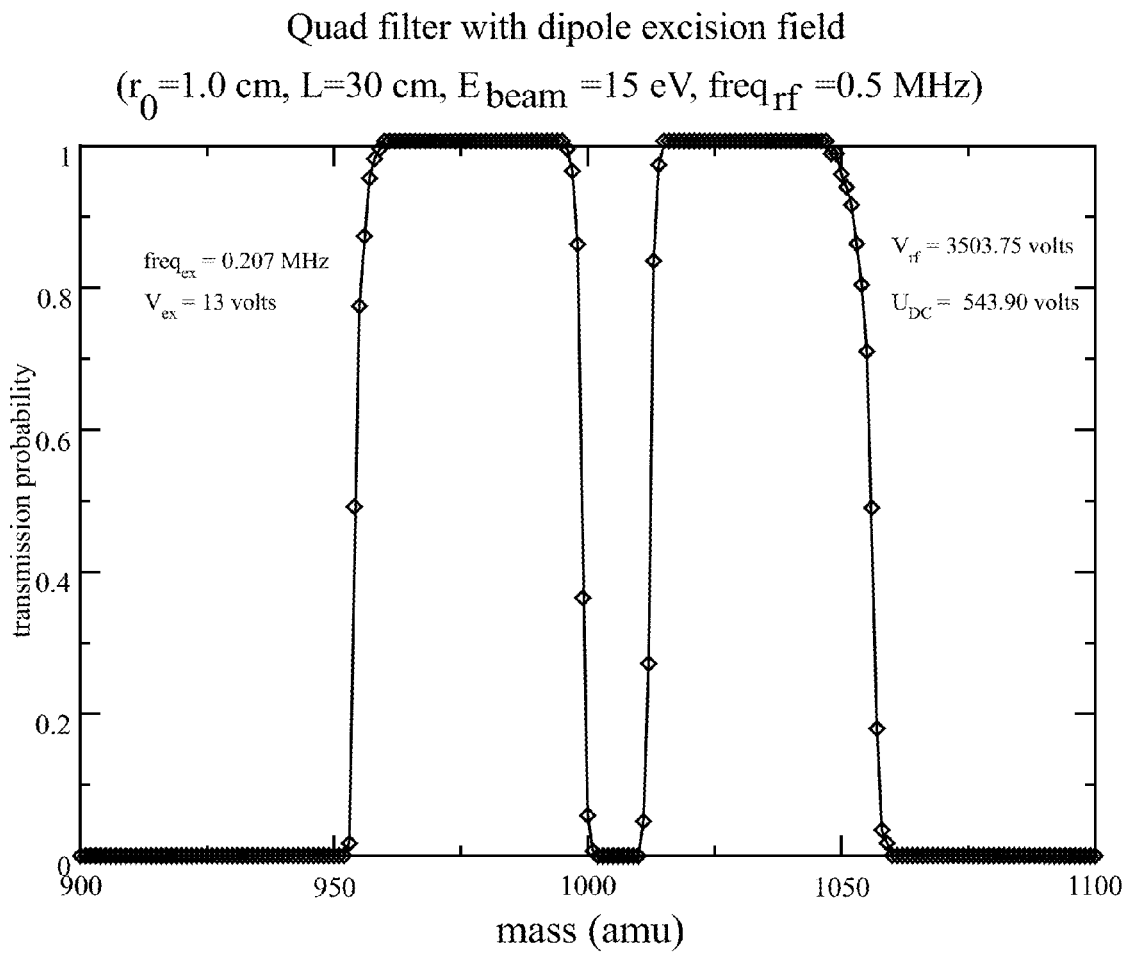
FIGS. 8 and 9 are similar to FIG. 7, illustrating how the rejection notch may be tuned across the wide passband to generate a filter function as disclosed herein.
Figure 9:
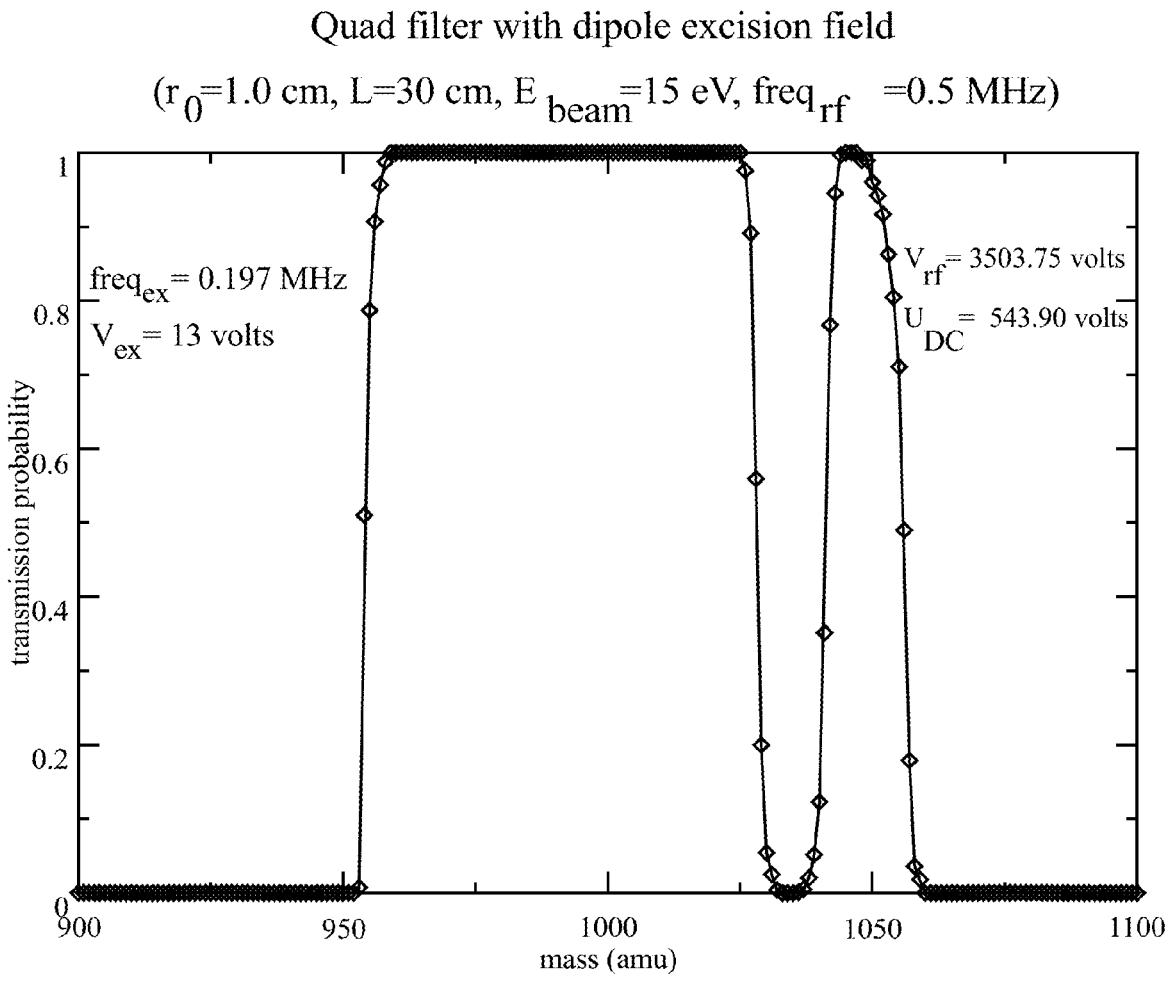

FIGS. 6-9 show numerically modeled results of a non-limiting example of implementing the tunable mass-notch filter to produce the sequential ion filtering function shown in FIGS. 4A to 4D. In this example quadrupole dimensions are $r_0$=1.0 cm, the inscribed radius shown in FIG. 2, and L=30.0 cm, the length of the ion guide electrodes 262 and 264 along the longitudinal axis 260. The RF quadrupole voltage $V_{RF}$ is chosen to be 3503.75 volts at a drive frequency Ω of 500 kHz, and the DC voltage $U_{DC}$ added thereto is chosen to be 543.90 volts, which acting together produce a nominal passband of roughly 100 atomic mass unit per charge (amu/z) centered at approximately 1000 amu/z. FIG. 6 illustrates the calculated form of this nominal passband (depicted as a plot of transmission probability as a function of mass (amu)) with no applied excision voltage. FIG. 7 illustrates the calculated form of the passband when an excision voltage is applied as described above, which produces a notch in the passband. Specifically, the RF excision voltage $V_{EX}$ is chosen to be 13.0 volts at an excision frequency of 220 kHz, which produces a 10 amu/z notch in the passband. FIGS. 8 and 9 illustrate how the rejection notch may be tuned across the nominal passband to generate the filter function disclosed herein. As the frequency of the excision voltage is decreased to 207 kHz (FIG. 8) and then to 197 kHz (FIG. 9), the notch is shifted to successively higher mass sub-ranges of the passband, i.e., the notch "moves" to the right along the mass axis. It will be understood that the dimensions, voltages, and frequencies specified in this example are merely illustrative and thus do not limit the scope of the subject matter disclosed herein.

In the examples illustrated in FIGS. 4 and 7 to 9, the modulation format is characterized by the notch being successively shifted from the lowest mass sub-ranges to the highest mass sub-ranges of the passband. The present subject matter, however, encompasses any other modulation format that may be effective for implementing the filtering and correlation functions disclosed herein. Thus, as another example, the notch may be successively shifted from the highest mass sub-ranges to the lowest mass sub-ranges of the passband. As another example, the notch may be shifted from one position of the passband to another according to a pseudo-random sequence, such as may be generated by the computing device 124 (FIGS. 1A and 1B). In the latter case, for any given iteration the notch may span a sub-range of masses that are higher or lower than the sub-range spanned by the notch in the immediately preceding iteration, and the preceding sub-range may not be immediately adjacent to the current sub-range. The pseudo-random sequence may be implemented such that all sub-ranges of the passband are eventually covered during the measurement process, and no sub-range is repeated during the same measurement process.

An example of a method for performing tandem mass spectrometry will now be described. A sample is ionized as described above in conjunction with FIG. 1A, thereby producing a plurality of parent ions spanning a full parent mass range. The parent ions are then transmitted from the ion source 104 to the first mass analyzer 108. Conceptually, the full parent mass range consists of N parent mass sub-ranges of (equal or non-equal) mass width, as described above and illustrated in FIG. 5. In the process of measuring this plurality of parent ions, a filtering or modulation process as described above in conjunction with FIGS. 1A, 2, and 4 to 9 may be carried out in at least N iterations, and may be implemented or controlled by the above-noted modulator 148 (FIG. 1A). In the first iteration, a first packet of the parent ions are transmitted from the first mass analyzer 108 to the ion fragmentation device 112. The first packet spans the full parent mass range initially received by the first mass analyzer 108 (i.e., the entire passband capable of being transmitted by the first mass analyzer 108), except for a first rejected parent mass sub-range. The first rejected parent mass sub-range is one of the N parent mass sub-ranges shown in FIG. 5, and corresponds to the location of the narrow m/z rejection notch on the mass axis. In other words, during the first iteration the parent ions whose masses fall in the narrow rejection notch are removed from the ion beam, while all other ions in the passband are transmitted to the ion fragmentation device 112. The location of the rejection notch for the first iteration, and the respective locations of the rejection notch for all subsequent iterations, are dictated by the particular modulation format being implemented. In the example of FIGS. 4A to 4D, the rejection notch for the first iteration (FIG. 4A) corresponds to the lowest sub-range of the full parent mass range.

After transmitting the first packet to the ion fragmentation device 112, the parent ions of the first packet are fragmented to produce a plurality of first daughter ions. The first daughter ions are then transmitted to the second mass analyzer 116, where they are mass-resolved and then measured by the ion detector 120. The ion detector signal from the ion detector 120 is processed and recorded as appropriate to acquire and store first daughter spectral data.

The above process is repeated in at least (N−1) additional iterations respectively performed on at least (N−1) additional parent ion packets. Thus, after the first iteration an additional plurality of parent ions spanning the full parent mass range, as produced in the ion source 104, are transmitted to the first mass analyzer 108. In this second iteration, a second packet of the parent ions are transmitted from the first mass analyzer 108 to the ion fragmentation device 112. The second packet spans the full parent mass range initially received by the first mass analyzer 108 except for a second rejected parent mass sub-range. The second rejected parent mass sub-range is again one of the N parent mass sub-ranges shown in FIG. 5, but is a different one than the one utilized in the first iteration. Again, the location of the rejection notch for the second iteration is dictated by the particular modulation format being implemented. Continuing with the example of FIGS. 4A to 4D, the rejection notch for the second iteration (FIG. 4B) corresponds to the next lowest sub-range of the full parent mass range. The parent ions of the second packet are then fragmented to produce a plurality of second daughter ions. The second daughter ions are then transmitted to the second mass analyzer 116, where they are mass-resolved and then measured by the ion detector 120. The ion detector signal from the ion detector 120 is processed and recorded as appropriate to acquire and store second daughter spectral data.

More generally, in each additional iteration, a new packet of the parent ions is transmitted to the fragmentation device. The new packet spans the full parent mass range except for a new rejected mass sub-range different from rejected mass sub-range of the first iteration and of any other iteration previous to the current iteration. The new packet is fragmented to produce a plurality of new daughter ions, and the new daughter ions are measured to acquire new daughter spectral data.

The measurement process may cease after at least N ion packets have been processed in the foregoing manner, resulting in the acquisition of N sets of daughter ion spectral data. It can be seen from FIGS. 4A to 4D that, due to the wide passband of parent ions utilized in the present method, parent ions of the same given mass are fragmented into daughter ions during up to (N−1) of the total iterations, leading to strong ion signals for the detected daughter ions produced from these parent ions. However, also due to the wide passband, daughter ions in each of the N sets are produced from a wide mass range of parent ions. Therefore, the daughter ion spectral data acquired after N iterations must be disentangled in order to be able to discern which specific daughter ions came from which specific intact parent ions. Accordingly, the method further entails selecting one or more of the N parent mass sub-ranges, and associating a group of measured daughter ions from the total acquired daughter ion spectral data with each respective parent mass sub-range selected for association. In other words, for each selected parent mass sub-range, the method determines which group of daughter ions corresponds to (was derived from) that particular parent mass sub-range. This may be implemented or controlled by the above-noted correlator 152 (FIG. 1A).

In some embodiments, the method may include storing the associations made between measured daughter ions and corresponding parent ions in a memory, for a variety of purposes such as, for example, constructing a database or library, facilitating an analysis and/or display of the acquired spectral data, etc. The data stored may include an identification of the selected parent mass sub-range (or one or more parent ions in the selected parent mass sub-range) and the spectral data of the group of measured daughter ions associated with the selected parent mass sub-range (or one or more parent ions in the selected parent mass sub-range).

In some embodiments, the method may include introducing a flow of the sample into the ion source 104 from an analytical separation instrument such as, for example, a gas chromatography (GC) or liquid chromatography (LC) instrument. Due to the operation of the analytical separation instrument, the sample may flow into the ion source 104 as one or more separated bands (peaks) containing different analyte compounds. In some embodiments, the method may be performed on the time scale of the eluting bands. Hence, in some embodiments the steps of the method described above may be repeated one or more times for one or more of the separated bands. That is, the method may be performed at least once on each band selected for analysis. Moreover, the method may be repeated one or more times on any one of the bands.

A non-limiting example of associating measured daughter ions with corresponding parent ions will now be described. First, let the set of quantities $S_i$ be the measured daughter spectrum (at the second mass analyzer 116) when the $i^{th}$ window is "closed" (i.e., the $i^{th}$ transmission null is operative), where i=1, 2, . . . N. Let the set of quantities $\xi_j$ be the expected daughter spectrum (at the second mass analyzer 116) when only the $j^{th}$ window is "open." Clearly, what is desired is the set of quantities $\xi_j$ (the daughter spectra generated by a very limited subset of parent ions), and what is measured is the set of quantities $S_i$ (the daughter spectra generated by a large, almost complete, set of parent ions). These two sets of quantities may be connected for the exemplary modulation format. The quantities satisfy the following set of equations:

$$S_1 = 0 + \xi_2 + \xi_3 + \xi_4 + \ldots \ldots \ldots \ldots \ldots \ldots + \xi_N \tag{1}$$

$$S_2 = \xi_1 + 0 + \xi_3 + \xi_4 + \ldots \ldots \ldots \ldots \ldots \ldots + \xi_N$$

$$S_3 = \xi_1 + \xi_2 + 0 + \xi_4 + \ldots \ldots \ldots \ldots \ldots \ldots + \xi_N$$

-continued $$\ldots$$

$$\ldots$$

$$\ldots$$

$$S_N = \xi_1 + \xi_2 + \xi_3 + \xi_4 + \ldots \ldots \ldots \ldots \ldots \ldots + 0$$

The above equations show an example of how the measured daughter ion mass spectra may be modulated as a result of shape-modulating the wide m/z passband of the first mass analyzer 108.

The desired daughter spectra $\xi_j$ may be found by summing and inverting the above equations, as follows:

$$\sum_{i=1}^{N} S_i - (N-1)S_j = (N-1)\xi_j \tag{2}$$

or $$\xi_j = \left(\frac{1}{N-1}\right)\sum_{i=1}^{N} S_i - S_j \tag{3}$$

In other words, by taking the simple algebraic combination of the measured $S_i$ as shown on the left side of Equation (2), the desired daughter spectra $\xi_j$ can be determined as shown on the right side of Equation (2). In this way, the desired simplified spectra can be determined, but with an (N−1)-fold increase in the number of ions measured, as explicitly shown in Equation (2). The above calculations may be performed, for example, by the correlator 152 of the computing device 124 schematically illustrated in FIGS. 1A and 1B.

Equations (1) to (3) explicitly show how the set of quantities $\xi_j$ (the daughter spectra generated by a very limited subset of parent ions) are determined from the measured set of quantities $S_i$ (the daughter spectra generated by a large, almost complete, set of parent ions).

Two metrics that determine the efficacy of this method are: (1) the increase in the signal-to-noise ratio (SNR) of the "true" peaks in the computed daughter spectra, and (2) the relative magnitudes of the residual "false" peaks that remain in the computed daughter spectra, $\xi_j$.

Regarding the increase in daughter peak SNR, from the right-side of Equation (2) it is clear that the number of measured ions contributing to the determination of $\xi_j$ is increased by a factor of (N−1) over the standard method. Assuming that the SNR is dominated by counting statistics:

$$SNR((N-1)\xi_j) \sim \frac{(N-1)\xi_j}{\sqrt{(N-1)\xi_j}} \sim \sqrt{(N-1)}\, SNR(\xi_j) \tag{4}$$

and the SNR is simply increased by a factor of (N−1).

Regarding the relative magnitudes of the residual "false" peaks in the daughter spectra, they can be estimated assuming that the measured ion signals are roughly dominated by counting statistics. Let the residual false ion signals be defined as $\Delta\xi_k$. These signals arise due to imperfect cancellations between the measured signals during the computations represented by the left side of Equation (2). This imperfect cancellation is represented by including "one-standarddeviation errors" to the ideal measured signals when evaluating the left side of Equation (2) for a false peak:

$$\Delta\xi_k \equiv ((N-1)\xi_k \pm \sqrt{(N-1)\xi_k}) - (N-1)(\xi_k \pm \sqrt{\xi_k}) \quad (5)$$

which for large N is approximately:

$$\Delta\xi_k \sim \pm(N-1)\sqrt{\xi_k}. \quad (6)$$

Thus, the fractional "false" daughter peak remaining (with respect to the un-cancelled summed daughter peak) due to statistically-induced imperfect cancellation is given by:

$$\frac{\Delta\xi_k}{(N-1)\xi_k} = \frac{\pm(N-1)\sqrt{\xi_k}}{(N-1)\xi_k} = \pm\frac{1}{\sqrt{\xi_k}}. \quad (7)$$

Therefore, the algorithmically-determined daughter spectrum can have small "phantom" daughter peaks that are shadows of parents from other spectra. Note that they are quite small. For example, a peak that contains ~$10^4$ ions could have a statistical shadow peak on the order of ~100 ions. It should also be mentioned that the algorithmically-induced shadow peak could be negative due to the imperfect cancellation.

It is clear that if the various parent ions under study do not have common (fragment) daughter ions, the small "false" shadow peaks are not an issue. In this case, any daughter peak that is significantly decreased in an algorithmically-determined daughter spectrum should be ignored. However, if there are common daughter ions for different parent ions, the quantitation of the daughter ion spectra will be distorted on the level indicated by Equation (7).

In the context of the present disclosure, as a non-limiting example, the width of a "wide" m/z passband (or "wide mass passband) may be 100 amu or greater. In other non-limiting examples, the width of the "wide" m/z passband may be a few hundred to several hundred amu or greater, or on the order of hundreds of amu. In yet another example, in an MS-MS experiment covering a full parent mass range of 400 amu (lowest ion mass) to 1200 amu (highest ion mass) and thus a full passband of width 800 amu, the system may be set up for notching 32 sequential 25-amu rejection windows, and recording the resulting 32 partial spectra.

These spectra may then be employed in conjunction with Equation (3) above to match the observed daughter mass peaks with the appropriate parent mass window. This procedure may be performed within the same time frame as the conventional measurements. The number of notches (iterations) could also be increased or decreased, with an attendant change in the notch width, to accommodate a different parent mass spectral density, or to accommodate different time restrictions.

Exemplary Embodiments

Exemplary embodiments provided in accordance with the presently disclosed subject matter include, but are not limited to, the following:

1. A tandem mass spectrometry (MS) system, comprising: a first mass analyzer configured for receiving a plurality of parent ions spanning a full parent mass range, wherein the full parent mass range comprises N parent mass sub-ranges; an ion fragmentation device; a second mass analyzer; an ion detector; and a computing device configured for: controlling the first mass analyzer, the ion fragmentation device, the second mass analyzer, and the ion detector according to a modulation format comprising the following steps: (i) in a first iteration, transmitting a first packet of the parent ions received by the first mass analyzer to a fragmentation device, wherein the first packet spans the full parent mass range except for a first rejected sub-range, the first rejected sub-range being one of the N parent mass sub-ranges; (ii) fragmenting the parent ions of the first packet to produce a plurality of first daughter ions; (iii) measuring the first daughter ions to acquire first daughter spectral data; (iv) repeating steps (i) to (iii) for at least (N−1) additional iterations wherein, in each additional iteration, a new packet of the parent ions is transmitted to the fragmentation device, the new packet spans the full parent mass range except for a new rejected sub-range different from rejected sub-range of the first iteration and of any other previous iteration, the new packet is fragmented to produce a plurality of new daughter ions, and the new daughter ions are measured to acquire new daughter spectral data; selecting one of the N parent mass sub-ranges; and associating a group of measured daughter ions from the acquired daughter spectral data with the selected parent mass sub-range, wherein the group corresponds to daughter ions produced from parent ions of the selected parent mass sub-range.

2. The tandem MS system of embodiment 1, wherein the first mass analyzer comprises a mass filter or a multipole ion guide.

3. The tandem MS system of embodiment 1 or 2, wherein the N parent mass sub-ranges are of equal or non-equal mass width.

4. The tandem MS system of any of the preceding embodiments, wherein the first mass analyzer is configured for generating a radio frequency (RF) multipole confining field that establishes a passband through which ions are transmitted to the ion fragmentation device, and an RF excision field that establishes a rejection notch in the passband.

5. The tandem MS system of embodiment 4, wherein the computing device is configured for changing a position of the rejection notch in the passband in each iteration by changing a frequency of the RF excision field.

6. The tandem MS system of embodiment 4 or 5, wherein the first mass analyzer is configured for applying the RF multipole confining field at a first frequency, and for applying the RF excision field at a second frequency lower than the first frequency.

7. The tandem MS system of embodiment 6, wherein the first frequency is in a range of 100 KHz to 10 MHz, and the second frequency is in a range of 20 KHz to 5 MHz.

8. The tandem MS system of embodiment 6, wherein the second frequency is in a range of 20% to 50% of the first frequency.

9. The tandem MS system of any of embodiments 4 to 8, wherein the first mass analyzer is configured for applying the RF multipole confining field at a first peak amplitude in a range of 500 V to 5000 V, and for applying the RF excision field at a second peak amplitude in a range of 1 V to 1000 V.

10. The tandem MS system of embodiment 9, wherein the second peak amplitude is in a range of 0.02% to 20% of the first peak amplitude.

11. A method for performing tandem mass spectrometry, the method comprising: (a) ionizing a sample to produce a plurality of parent ions spanning a full parent mass range, wherein the full parent mass range comprises N parent mass sub-ranges; (b) in a first iteration, transmitting a first packet of the parent ions to a fragmentation device, wherein the first packet spans the full parent mass range except for a first rejected sub-range, the first rejected sub-range being one of the N parent mass sub-ranges; (c) fragmenting the parent ions of the first packet to produce a plurality of first daughter ions; (d) measuring the first daughter ions to acquire first daughter spectral data; (e) repeating steps (b) to (d) for at least (N−1) additional iterations wherein, in each additional iteration, a new packet of the parent ions is transmitted to the fragmentation device, the new packet spans the full parent mass range except for a new rejected sub-range different from rejected sub-range of the first iteration and of any other previous iteration, the new packet is fragmented to produce a plurality of new daughter ions, and the new daughter ions are measured to acquire new daughter spectral data; (f) selecting one of the N parent mass sub-ranges; and (g) associating a group of measured daughter ions from the acquired daughter spectral data with the selected parent mass sub-range, wherein the group corresponds to daughter ions produced from parent ions of the selected parent mass sub-range.

12. The method of embodiment 11, comprising transmitting packets to the fragmentation device during the N iterations according to a passband modulation that determines which mass sub-range is rejected in each iteration.

13. The method of embodiment 12, wherein associating the group of measured daughter ions comprises correlating the acquired daughter spectral data with the passband modulation.

14. The method of embodiment 12 to 13, wherein the passband modulation is selected from the group consisting of: the rejected mass sub-ranges are ordered over the iterations from the lowest mass range to the highest mass range of the full parent mass range; the rejected mass sub-ranges are ordered over the iterations from the highest mass range to the lowest mass range of the full parent mass range; and the rejected mass sub-ranges are ordered over the iterations according to a pseudo-random sequence.

15. The method of any of embodiments 11 to 14, comprising (h) storing, in a memory, an identification of the selected parent mass sub-range and the spectral data of the group of measured daughter ions associated with the selected parent mass sub-range.

16. The method of embodiment 15, comprising repeating steps (f) to (h) for one or more other parent mass sub-ranges.

17. The method of any of embodiments 11 to 16, wherein ionizing the sample is done in an ion source, and further comprising flowing the sample as one or more separated bands from an analytical separation device to the ion source, and repeating steps (a) to (g) one or more times for one or more of the separated bands.

18. The method of any of embodiments 11 to 17, wherein: transmitting the first packet comprises establishing a passband through which ions are transmitted to the ion fragmentation device, and establishing a rejection notch in the passband, wherein the rejection notch determines the rejected sub-range; and transmitting the new packet comprises adjusting a position of the rejection notch in the passband.

19. The method of embodiment 18, comprising establishing the passband by generating a radio frequency (RF) multipole confining field in a mass analyzer, establishing the rejection notch by generating an RF excision field in the mass analyzer, and adjusting the position of the rejection notch by adjusting a frequency of the RF excision field.

20. The method of embodiment 19, wherein the RF excision field is a dipole field or a quadrupole field.

21. The method of any of the preceding embodiments, wherein the RF multipole confining field is an RF-only field or an RF/DC field.

22. The method of any of the preceding embodiments, the width of the "wide" m/z passband may be 100 amu or greater, a few hundred to several hundred amu or greater, or on the order of hundreds of amu.

23. A spectrometry system configured for performing all or part of the method of any of the preceding embodiments.

24. A system for performing tandem mass spectrometry, the system comprising: a processor and a memory configured for performing all or part of the method of any of the preceding embodiments.

25. A computer-readable storage medium comprising instructions for performing all or part of the method of any of the preceding embodiments.

26. A system comprising the computer-readable storage medium of embodiment 25.

Methods for performing tandem mass spectrometry such as described above and illustrated in the Figures may be performed (carried out), for example, in a system that includes a processor and a memory as may be embodied in, for example, a computing device which may communicate with a user input device and/or a user output device. In some embodiments, the system for performing tandem mass spectrometry (or an associated computing device) may be considered as including the user input device and/or the user output device. As used herein, the term "perform" or "carry out" may encompass actions such as controlling and/or signal or data transmission. For example, a computing device such as illustrated in FIGS. 1A and 1B, or a processor thereof, may perform a method step by controlling another component involved in performing the method step. Performing or controlling may involve making calculations, or sending and/or receiving signals (e.g., control signals, instructions, measurement signals, parameter values, data, etc.).

As used herein, an "interface" or "user interface" is generally a system by which users interact with a computing device. An interface may include an input (e.g., a user input device) for allowing users to manipulate a computing device, and may include an output (e.g., a user output device) for allowing the system to present information and/or data, indicate the effects of the user's manipulation, etc. An example of an interface on a computing device includes a graphical user interface (GUI) that allows users to interact with programs in more ways than typing. A GUI typically may offer display objects, and visual indicators, as opposed to (or in addition to) text-based interfaces, typed command labels or text navigation to represent information and actions available to a user. For example, an interface may be a display window or display object, which is selectable by a user of a computing device for interaction. The display object may be displayed on a display screen of a computing device and may be selected by and interacted with by a user using the interface. In one non-limiting example, the display of the computing device may be a touch screen, which may display the display icon. The user may depress the area of the touch screen at which the display icon is displayed for selecting the display icon. In another example, the user may use any other suitable interface of a computing device, such as a keypad, to select the display icon or display object. For example, the user may use a track ball or arrow keys for moving a cursor to highlight and select the display object.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the computing device 124 schematically depicted in FIGS. 1A and 1B. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the computing device 124 in FIGS. 1A and 1B), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A tandem mass spectrometry (MS) system, comprising:

a first mass analyzer configured for receiving a plurality of parent ions spanning a full parent mass range, wherein the full parent mass range comprises N parent mass sub-ranges;

an ion fragmentation device;

a second mass analyzer;

an ion detector; and a computing device configured for:

controlling the first mass analyzer, the ion fragmentation device, the second mass analyzer, and the ion detector according to a modulation format comprising the following steps:

(i) in a first iteration, transmitting a first packet of the parent ions received by the first mass analyzer to a fragmentation device, wherein the first packet spans the full parent mass range except for a first rejected sub-range, the first rejected sub-range being one of the N parent mass sub-ranges;

(ii) fragmenting the parent ions of the first packet to produce a plurality of first daughter ions;

(iii) measuring the first daughter ions to acquire first daughter spectral data;

(iv) repeating steps (i) to (iii) for at least (N−1) additional iterations wherein, in each additional iteration, a new packet of the parent ions is transmitted to the fragmentation device, the new packet spans the full parent mass range except for a new rejected sub-range different from rejected sub-range of the first iteration and of any other previous iteration, the new packet is fragmented to produce a plurality of new daughter ions, and the new daughter ions are measured to acquire new daughter spectral data;

selecting one of the N parent mass sub-ranges; and associating a group of measured daughter ions from the acquired daughter spectral data with the selected parent mass sub-range, wherein the group corresponds to daughter ions produced from parent ions of the selected parent mass sub-range.

2. The tandem MS system of claim 1, wherein the first mass analyzer comprises a mass filter or a multipole ion guide.

3. The tandem MS system of claim 1, wherein the N parent mass sub-ranges are of equal or non-equal mass width.

4. The tandem MS system of claim 1, wherein the first mass analyzer is configured for generating a radio frequency (RF) multipole confining field that establishes a passband through which ions are transmitted to the ion fragmentation device, and an RF excision field that establishes a rejection notch in the passband.

5. The tandem MS system of claim 4, wherein the computing device is configured for changing a position of the rejection notch in the passband in each iteration by changing a frequency of the RF excision field.

6. The tandem MS system of claim 4, wherein the first mass analyzer is configured for applying the RF multipole confining field at a first frequency, and for applying the RF excision field at a second frequency lower than the first frequency.

7. The tandem MS system of claim 6, wherein the first frequency is in a range of 100 KHz to 10 MHz, and the second frequency is in a range of 20 KHz to 5 MHz.

8. The tandem MS system of claim 6, wherein the second frequency is in a range of 20% to 50% of the first frequency.

9. The tandem MS system of claim 4, wherein the first mass analyzer is configured for applying the RF multipole confining field at a first peak amplitude in a range of 500 V to 5000 V, and for applying the RF excision field at a second peak amplitude in a range of 1 V to 1000 V.

10. The tandem MS system of claim 9, wherein the second peak amplitude is in a range of 0.02% to 20% of the first peak amplitude.

11. A method for performing tandem mass spectrometry, the method comprising:

(a) ionizing a sample to produce a plurality of parent ions spanning a full parent mass range, wherein the full parent mass range comprises N parent mass sub-ranges;

(b) in a first iteration, transmitting a first packet of the parent ions to a fragmentation device, wherein the first packet spans the full parent mass range except for a first rejected sub-range, the first rejected sub-range being one of the N parent mass sub-ranges;

(c) fragmenting the parent ions of the first packet to produce a plurality of first daughter ions;

(d) measuring the first daughter ions to acquire first daughter spectral data;

(e) repeating steps (b) to (d) for at least (N−1) additional iterations wherein, in each additional iteration, a new packet of the parent ions is transmitted to the fragmentation device, the new packet spans the full parent mass range except for a new rejected sub-range different from rejected sub-range of the first iteration and of any other previous iteration, the new packet is fragmented to produce a plurality of new daughter ions, and the new daughter ions are measured to acquire new daughter spectral data;

(f) selecting one of the N parent mass sub-ranges; and (g) associating a group of measured daughter ions from the acquired daughter spectral data with the selected parent mass sub-range, wherein the group corresponds to daughter ions produced from parent ions of the selected parent mass sub-range.

12. The method of claim 11, comprising transmitting packets to the fragmentation device during the N iterations according to a passband modulation that determines which mass sub-range is rejected in each iteration.

13. The method of claim 12, wherein associating the group of measured daughter ions comprises correlating the acquired daughter spectral data with the passband modulation.

14. The method of claim 12, wherein the passband modulation is selected from the group consisting of: the rejected mass sub-ranges are ordered over the iterations from the lowest mass range to the highest mass range of the full parent mass range; the rejected mass sub-ranges are ordered over the iterations from the highest mass range to the lowest mass range of the full parent mass range; and the rejected mass sub-ranges are ordered over the iterations according to a pseudo-random sequence.

15. The method of claim 11, comprising (h) storing, in a memory, an identification of the selected parent mass sub-range and the spectral data of the group of measured daughter ions associated with the selected parent mass sub-range.

16. The method of claim 15, comprising repeating steps (f) to (h) for one or more other parent mass sub-ranges.

17. The method of claim 11, wherein ionizing the sample is done in an ion source, and further comprising flowing the sample as one or more separated bands from an analytical separation device to the ion source, and repeating steps (a) to (g) one or more times for one or more of the separated bands.

18. The method of claim 11, wherein:

transmitting the first packet comprises establishing a passband through which ions are transmitted to the ion fragmentation device, and establishing a rejection notch in the passband, wherein the rejection notch determines the rejected sub-range; and transmitting the new packet comprises adjusting a position of the rejection notch in the passband.

19. The method of claim 18, comprising establishing the passband by generating a radio frequency (RF) multipole confining field in a mass analyzer, establishing the rejection notch by generating an RF excision field in the mass analyzer, and adjusting the position of the rejection notch by adjusting a frequency of the RF excision field.

20. The method of claim 19, wherein the RF excision field is a dipole field or a quadrupole field.

* * * * *